United States Patent [19]

Ritter

[11] 4,086,786

[45] May 2, 1978

[54] TWO PART PIERCING EARRING WITH AN ORNAMENT ON EACH PART

[76] Inventor: Arthur F. Ritter, 235 E. 87th St., New York, N.Y. 10028

[21] Appl. No.: 720,595

[22] Filed: Sep. 7, 1976

[51] Int. Cl.[2] ..... A44C 7/00

[52] U.S. Cl. ..... 63/13; 63/14 E

[58] Field of Search ..... 63/12, 13, 14 B, 14 E, 63/29 R

[56] References Cited

U.S. PATENT DOCUMENTS

| | | | |
|---|---|---|---|
| 263,755 | 9/1882 | Braverman | 63/12 |
| 718,708 | 1/1903 | Geiger et al. | 63/13 |
| 758,848 | 5/1904 | Pejchar | 63/13 X |
| 2,420,531 | 5/1947 | Francis | 63/14 E |
| 3,443,398 | 5/1969 | King | 63/13 |
| 3,504,507 | 4/1970 | Ferro | 63/12 X |
| 3,789,850 | 5/1974 | Ford | 63/12 X |

FOREIGN PATENT DOCUMENTS

| | | | |
|---|---|---|---|
| 907,214 | 6/1945 | France | 63/13 |

*Primary Examiner*—F. Barry Shay

*Attorney, Agent, or Firm*—Posnack, Roberts & Cohen

[57] ABSTRACT

A first support for a first decorative dangle is provided with a plurality of links supporting said dangle. A second support is also provided with a plurality of links which support a second dangle of the same shape as the first or a different shape. The two supports are interconnected by an attaching element which in one embodiment of the invention is designed for use with pierced ears. In this first embodiment, the attaching element is an elongated pin which is received in a passageway formed in the second support and is held in the passageway by curled members. In a second embodiment, the attaching element is designed for use in non-pierced ears and has a U-shaped brace connected at one end to the first support and has at its other end a clamping plate which receives therethrough a threaded pin of the second support. The dangles supported by the first and second supports are independently floating and are located on opposite sides of the ear lobe. By interchanging the supports in different pairs of earrings, different design effects are obtained. In addition, slots may be provided in the links supporting the dangles to add further possibilities of design changes.

4 Claims, 3 Drawing Figures

TWO PART PIERCING EARRING WITH AN ORNAMENT ON EACH PART

BACKGROUND OF THE INVENTION

The present invention is directed to an earring which is easily and readily attached to an ear lobe, and which allows for the sandwiching of the ear lobe by two dangles.

There are many known earring constructions designed for ears that are pierced and non-pierced. Examples for such earrings are shown in U.S. Pat. Nos. 292,810; 718,708 and 758,848.

SUMMARY OF THE INVENTION

It is a primary object of the present invention to provide an earring that offers a pair of dangles which sandwich therebetween or are arranged on opposite sides of the ear lobe of the wearer of the earring, and which allows for the interchanging of the dangles.

To this end, the present invention is provided with first and second support means which support first and second dangles, respectively, via a plurality of first and second links. The support means of different sets of earrings can be interchanged, thereby varying the pairing of the dangles and providing, as a result, different designs. In addition, one of the links in at least one of the first and second plurality links may further be provided with a slot so that a dangle may be removed and replaced with a differently shaped and/or designed dangle.

A first embodiment of the invention may be designed for use with a pierced ear lobe. In this embodiment, the first support means has extending therefrom an elongated pin which is received through a central opening formed in the second support means. The second support means has, extending from a retaining plate thereof, an upper and a lower curled member which define therebetween a passageway that is aligned with the central opening formed in the retaining plate. The passageway receives therein the elongated pin and holds the pin therein by the pressure of the upper and lower curled members. The upper and lower curled members may hold the elongated pin fast, as by friction, or by contacting a circular groove formed in the end of the elongated pin nearest the second support means. By virtue of the suspended system of links, the dangles are freely floating and positioned on either side of the ear lobe of the wearer of the earring.

A second embodiment of the invention is designed for use with a non-pierced ear. In this embodiment, a U-shaped brace extends at one end thereof from the first support means and has at its second end a plate with a central opening formed therethrough. The second support means has a threaded elongated pin which extends through the central opening of the plate and which has at its first end closest to the first support means a clamping plate for holding the earring against the ear lobe of the wearer of the earring. The second end of the threaded elongated pin farthest from the first support means has a screw backing plate for turning the threaded elongated pin to urge the clamping plate against the ear lobe. The plurality of second links extend downwardly from the threaded elongated pin so as to be freely floating. The first support means and first links are the same as that in the first embodiment.

BRIEF DESCRIPTION OF THE DRAWING

The invention will be more readily understood with reference to the following detailed description, when taken in conjunction with the accompanying drawing, wherein.

DETAILED DESCRIPTION OF THE INVENTION

Figure 1:
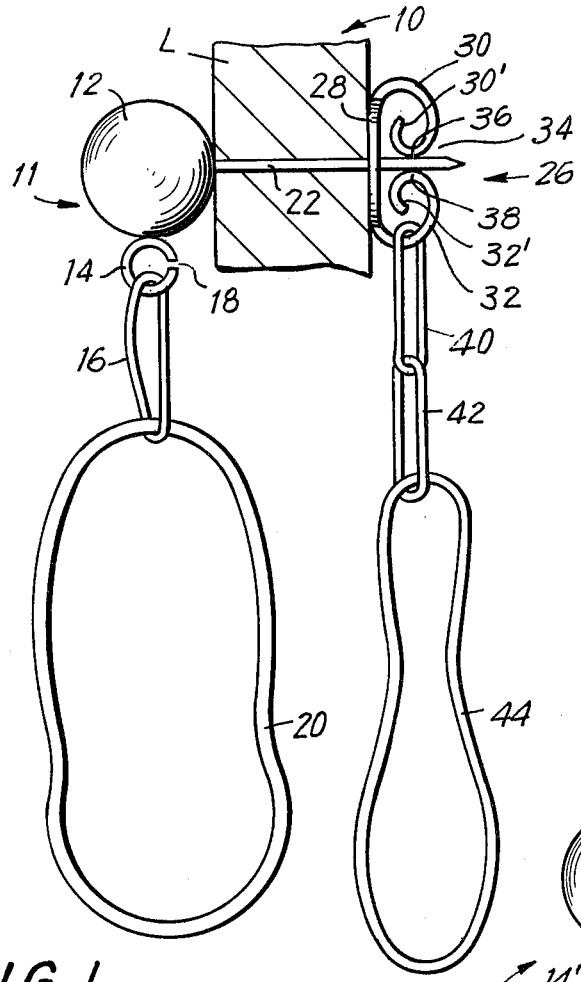
FIG. 1 is a schematic plan view of the first embodiment of the invention for use with pierced ear lobes.

Referring now to FIG. 1, there is shown the first embodiment of the invention designed for use with a pierced ear lobe L. The earring 10 has a first support means 11 which has a bead 12 or the like. Extending downwardly from the bead 12 is a plurality of first links 14 and 16. Although only two such first links have been shown, it is to be understood that a greater number may be used.

The first uppermost link 14 of the first set of links may optionally be provided with a slot 18 so that the other link 16 may be removed therefrom. The other lowermost link 16 supports thereon a decorative dangle 20, which may be of any desired shape, such as a heart, ring, free form loop, etc. By removing the lowermost link 16 from the uppermost link 14 via the slot 18, a differently shaped dangle may be attached to the bead 12.

The bead 12 has, extending in a plane at right angles to the plane containing the first links 14 and 16, an elongated pin 22 which, as described below, is used for securing the earring to the second support means. A second support means 26 has a retainer which is comprised of a decorative retaining plate 28 and an upper curled member 30 and a lower curled member 32. The curled members 30 and 32 extend rearwardly of the retaining plate 28 and are connected to the retaining plate 28 at diammetrically opposed portions of the plate. Each of the curled members has a spiral shaped portion 30', 32' which form therebetween a passageway 34 for the reception therethrough of the elongated pin 22.

Figure 2:
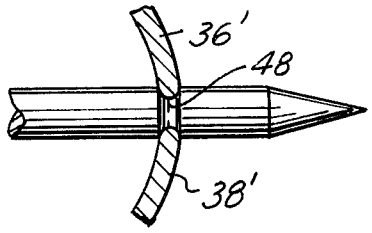
FIG. 2 shows a variation of the embodiment of FIG. 1.

The retaining plate has a central opening formed therethrough (not shown) which is in alignment with the passageway formed by the spiral shaped members 30', 32'. The passageway 34 is of such breadth as to receive snugly therein the pin 22 and to hold the pin therein by friction realized between the spiral members 30', 32' acting on the pin 22. Alternatively, the pin 22 may be provided with a circular groove 48 (FIG. 2) at the end thereof which receives therein the tip portions 36', 38' of spiral members 30', 32' which prevent the pin from moving in any lateral direction.

Extending downwardly from the lower curled member 32 are a plurality of second links 40, 42. While only two such second links have been shown, it is again to be understood that a greater number of such links may be provided. The link 40 may optionally be provided with a slot, as in the link 14 of the first support means 11.

Extending downwardly from the lowermost link 42, and supported thereby, is another decorative dangle 44 which may be of the same shape and design as the first dangle 20, or, optionally, may be of different shape and design. As a significant feature of the invention, in a plurality of sets of earrings, the supports can be interchangeably paired. Thus, with pairs of hearts and forms, a heart may be optionally paired with a free form.

In attaching the earring 10 to an ear lobe, it can be easily seen that pin 22 need only be inserted through the pierced ear and locked in place by the second support means 26. By virtue of the linkage system employed, the dangles are not just simply interchangeable but also freely floating on either side of the ear lobe.

Figure 3:
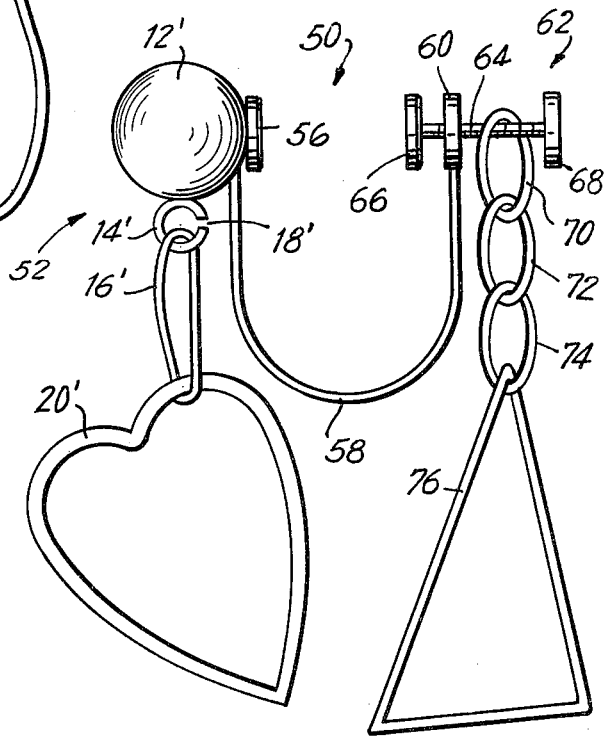
FIG. 3 is a schematic plan view of another embodiment of the invention for use with non-pierced ear lobes.

FIG. 3 shows another embodiment of the invention which is designed for use in a non-pierced ear. In this embodiment, the earring 50 has a first support means 52 similar to that of the first embodiment with the exception of a first clamping plate 56. Also, instead of the pin 22, a U-shaped brace member 58 is provided having a first end attached to the bead 12' from which extends the first links 14', 16', and the dangle 20'. The U-shaped brace member 58 has at its second end a plate means 60 with a central opening (not shown) formed therethrough.

The second support means 62 has a threaded elongated pin 64 for passage through the central opening of the plate means 60, and has at its first end nearest the first support means 52 a clamping plate 66 for contact with the ear lobe of the wearer of the earring of the present invention. At the second end farthest from the first support means 52, is a screw backing plate 66-68 which allows for the gripping thereof in order to rotate the threaded elongated pin 64 and thereby urge the clamping plate 66 toward or away from the ear lobe of the wearer of the earring of the present invention.

The second support means 62 also has a plurality of links 70, 72, 74, which in this instance is shown as three, although it is again to be understood that more or less than three links may be employed. The uppermost link 70 is supported by the threaded elongated pin 64, while the lowermost link 74 supports the dangle 76.

In this embodiment, as in the first, the dangle 20' may be interchanged with another differently shaped and designed dangle by removing the link 16' from the link 14' via the slot 18' formed therein. The dangles 20' and 76 need not be of the same shape and design, and are preferably different in this respect. Also, one of the links 70, 72 and 74 may also be provided with a slot similar to slot 18' so that a differently shaped and designed dangle 76 may be used.

While specific embodiments of the invention have been shown and described, it is to be understood that numerous changes and modifications may be made without departing from the scope and spirit of the invention. For example, the earring according to the second embodiment may be a clip-on type earring. Also, the first dangle attached to the first support means in both embodiments may be fixed to the bead rather than being freely floating.

What is claimed is:

1. An earring for attachment to an ear lobe, said earring comprising: first support means and second support means, said first and second support means being adapted for sandwiching said ear lobe therebetween, said first support means including pin means for extending through said ear lobe, said first and second support means being detachably connected via said pin means for the mounting and removing of said earring, first decorative means connected to said first support means, and second decorative means connected to said second support means, whereby said first and second decorative means hang from opposite sides of the ear lobe, said first support means comprising a plurality of first links connected to said pin means, said first decorative means being suspended from said plurality of first links; said second support means comprising a retainer, said retainer comprising a retaining plate having a central opening formed therethrough, curled members extending outwardly from said retaining plate, said curled members further extending in reverse directions toward each other so as to form therebetween a passageway axially aligned with said central opening, said pin means being insertable through said central opening such that said curled members retain said pin means in said passageway; said second support means further comprising a plurality of second links by which is suspended said second decorative means, said plurality of second links being engaged by one of said curled members.

2. An earring according to claim 1 wherein said pin means is provided with a circular groove by which said curled members yieldably grip said pin means.

3. An earring according to claim 1 wherein one of said plurality of first links is provided with a slot by which the links are adapted for being disconnected from each other.

4. An earring according to claim 1, wherein each of said first and second decorative means comprises a ring-shaped dangle, one of said first and second decorative means having a length less than that of the other.

* * * * *